US010323526B2

(12) United States Patent
Tsypkaykin et al.

(10) Patent No.: US 10,323,526 B2
(45) Date of Patent: Jun. 18, 2019

(54) BLADE WITH TIP SHROUD

(71) Applicant: ANSALDO ENERGIA SWITZERLAND AG, Baden (CH)

(72) Inventors: Igor Tsypkaykin, Turgi (CH); Julien Nussbaum, Battenheim (FR); Beat Von Arx, Trimbach (CH); Bruno Stephan, Kirchdorf (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 527 days.

(21) Appl. No.: 15/135,902

(22) Filed: Apr. 22, 2016

(65) Prior Publication Data

US 2016/0312625 A1 Oct. 27, 2016

(30) Foreign Application Priority Data

Apr. 22, 2015 (EP) ..... 15164642

(51) Int. Cl.
*F01D 5/20* (2006.01)
*F01D 5/14* (2006.01)
*F01D 5/22* (2006.01)

(52) U.S. Cl.
CPC ..... *F01D 5/20* (2013.01); *F01D 5/143* (2013.01); *F01D 5/147* (2013.01); *F01D 5/225* (2013.01);

(Continued)

(58) Field of Classification Search
CPC . F01D 5/20; F01D 5/143; F01D 5/147; F01D 5/225; F05D 2220/3215; F05D 2230/21; F05D 2240/307
See application file for complete search history.

(56) References Cited

U.S. PATENT DOCUMENTS 3,876,330 A * 4/1975 Pearson ..... F01D 5/18 415/115
4,940,388 A * 7/1990 Lilleker ..... F01D 5/187 416/97 R (Continued)

FOREIGN PATENT DOCUMENTS

EP 2 385 215 A1 11/2011
JP 2005-207294 A 8/2005

OTHER PUBLICATIONS

European Search Report dated Sep. 22, 2015, issued by the European Patent Office in the corresponding European Patent Application No. 15164642..9. (5 pages).

*Primary Examiner* — Jason D Shanske
*Assistant Examiner* — Joshua R Beebe
(74) *Attorney, Agent, or Firm* — Buchanan Ingersoll & Rooney PC

(57) ABSTRACT

A blade includes a leading edge, a trailing edge, a pressure surface, a suction surface, a root end, a tip end, a tip shroud attached to the tip end, the tip shroud comprising a platform and a fin, wherein the fin having a leading edge side facing towards the leading edge of the blade, a trailing edge side facing towards the trailing edge of the blade, a back end and a front end, the leading edge side and the trailing edge side extending between the back end and the front end, the fin extending across the tip end of the blade at an angle to the chord of the blade at the tip end of the blade. A first platform portion extends from the leading edge side of the fin to the suction surface. A second platform portion extends from the trailing edge side of the fin to the pressure surface at the tip end of the blade.

20 Claims, 3 Drawing Sheets

(52) U.S. Cl.
CPC .. *F05D 2220/3215* (2013.01); *F05D 2230/21* (2013.01); *F05D 2240/307* (2013.01)

(56) References Cited

U.S. PATENT DOCUMENTS 5,350,277 A 9/1994 Jacala et al.
6,402,474 B1 * 6/2002 Okuno ..... F01D 5/22 416/190
6,491,498 B1 12/2002 Seleski et al.
6,736,596 B2 * 5/2004 Ito ..... F01D 5/225 415/173.1
8,075,272 B2 * 12/2011 Riaz ..... F01D 5/14 416/191
8,096,767 B1 * 1/2012 Liang ..... F01D 5/187 415/115
8,118,557 B2 * 2/2012 DeMania ..... F01D 5/141 416/191
2005/0079058 A1 4/2005 Paquet et al.
2005/0111983 A1 * 5/2005 Goetzfried ..... F01D 5/22 416/191
2005/0287004 A1 * 12/2005 Barb ..... F01D 5/141 416/190
2008/0175712 A1 * 7/2008 Asai ..... F01D 5/16 416/179
2010/0290897 A1 * 11/2010 Beeck ..... F01D 5/225 415/173.1
2013/0058788 A1 * 3/2013 Brandl ..... F01D 5/187 416/95
2013/0142649 A1 * 6/2013 Collier ..... F01D 5/187 416/1
2013/0189106 A1 * 7/2013 Chouhan ..... F01D 5/225 416/179
2013/0236319 A1 * 9/2013 Rockarts ..... F01D 5/141 416/223 R

* cited by examiner

BLADE WITH TIP SHROUD

TECHNICAL FIELD

The present disclosure relates to blades with tip shrouds, and particularly to blades with tip shrouds comprising a fin and a platform.

BACKGROUND OF THE INVENTION

Turbine blades for heavy duty gas turbines are required to operate reliably at high speeds in a hostile environment. This is particularly true for end-stage turbine blades, which tend to be very long, placing considerable strain on the blades. Existing blade designs can provide damping of vibrations, lightweight design, or minimal over-tip leakage flow, but struggle to provide good performance in all of these areas at once, especially in end-stage turbine blades where the centrifugal forces are highest and the need for stiff and lightweight designs is particularly acute. As a result, it has been appreciated that the design of turbine blades could be refined to provide improved turbine blade performance, particularly in end-stage turbine blades.

SUMMARY OF THE INVENTION

The invention is defined in the appended independent claims to which reference should now be made. Advantageous features of the invention are set forth in the dependent claims.

A first aspect of the invention provides a blade comprising a leading edge, a trailing edge, a pressure surface, a suction surface, a root end and a tip end, the blade comprising a tip shroud attached to the tip end, the tip shroud comprising a platform and a fin, wherein the fin comprises a leading edge side facing towards the leading edge of the blade, a trailing edge side facing towards the trailing edge of the blade, a back end and a front end, the leading edge side and the trailing edge side extending between the back end and the front end, the fin extending across the tip end of the blade at an angle to the chord of the blade at the tip end of the blade, wherein the platform comprises a first platform portion and a second platform portion, wherein the first platform portion extends from the leading edge side of the fin between the front end of the fin and the suction surface at the tip end of the blade, to the suction surface at the tip end of the blade between the leading edge of the blade and the leading edge side of the fin, wherein the second platform portion extends from the trailing edge side of the fin between the back end of the fin and the pressure surface at the tip end of the blade, to the pressure surface at the tip end of the blade between the trailing edge of the blade and the trailing edge side of the fin, and wherein the tip shroud is delimited by the suction surface at the tip end of the blade between the trailing edge and the trailing edge side of the fin, and by the trailing edge side of the fin between the suction surface at the tip end of the blade and the front end of the fin.

This can provide an overall improvement in performance compared to existing blades. In particular, it can provide good performance in terms of minimising over-tip leakage flow and minimising the amount of material in the tip shroud to reduce the amount of material that has to pass through the narrow blade space in the mould during casting of the blade and to reduce centrifugal load on the blade aerofoil, blade root and rotor. The platform portion at the trailing edge-pressure surface area can reduce leakage and provide stiffness. The platform portion at the leading edge-suction surface area can increase stiffness.

In one embodiment, the fin comprises a fin platform end adjacent to the platform and a fin tip end distal from the platform, and the distance from the leading edge side of the fin to the trailing edge side of the fin is greater at the fin platform end than at the fin tip end. Variable thickness of fin can provide minimum weight whilst maintaining stiffness and minimising leakage.

In one embodiment, the distance from the leading edge side of the fin to the trailing edge side of the fin is greater near the front end of the fin, near the back end of the fin and/or near the tip end of the blade than elsewhere on the fin. Providing a thicker portion of the fin near the front and/or back end can provide sufficient stiffness despite contact between the fin and the next fin when in use. Being able to couple adjacent blades can improve damping. Providing a thicker portion near the tip end of the blade can provide good structural strength and stiffness while minimising the amount of material in the fin.

In one embodiment, the portion of the fin near the front end of the fin where the width between the leading edge side and the trailing edge side is greater is closer to the front end of the fin on the leading edge side of the fin than on the trailing edge side of the fin. This can provide the thicker portion in the most useful position on both sides of the fin.

In one embodiment, the platform comprises a third platform portion, wherein the third platform portion extends from the point where the pressure surface and the leading edge side of the fin meet, wherein the third platform portion extends along the pressure surface at the tip end of the blade between the leading edge of the blade and the leading edge side of the fin, and along the leading edge side of the fin between the suction surface at the tip end of the blade and the back end of the fin. This can improve structural strength and stiffness and reduce leakage. In one embodiment, the area of the third platform portion is at least three times smaller than the area of the first platform portion.

In one embodiment, the tip shroud is delimited by the pressure surface at the tip end of the blade between the leading edge and the leading edge side of the fin, and by the leading edge side of the fin between the pressure surface and the back end of the fin. This can minimise the amount of material in the tip shroud.

In one embodiment, an edge of the first platform portion extends in a straight or substantially straight line from the leading edge to the front end of the fin, and/or an edge of the second platform portion extends in a straight or substantially straight line from the trailing edge to the back end of the fin. This can minimise leakage and improve the stiffness of the tip shroud.

In one embodiment, a hole through the first and/or second platform portions is provided. This can minimise material usage and weight whilst still providing stiffness and structural strength.

In one embodiment, a first dust hole in the tip end of the blade between the leading edge side of the fin and the leading edge, and/or a second dust hole in the tip end of the blade between the trailing edge side of the fin and the trailing edge is provided.

In one embodiment, the second dust hole leads to a dust hole channel that extends through the blade in a longitudinal direction of the blade, wherein the dust hole channel is further away from the trailing edge at the tip end of the blade than elsewhere in the blade. Arranging the second dust hole in this way can have structural advantages, particularly in that the dust hole can be provided in a comparatively wide part of the blade tip whilst providing most of the dust hole channel closer to the trailing edge.

In one embodiment, a fillet radius where the fin meets the tip end of the blade is larger than a fillet radius where the platform meets the tip end of the blade. Fillet radius variation can help reduce weight.

A second aspect of the invention provides a gas turbine comprising a blade as described above. A third aspect of the invention provides a method of manufacture of a blade as described above, wherein the blade is formed by casting.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figure 1:
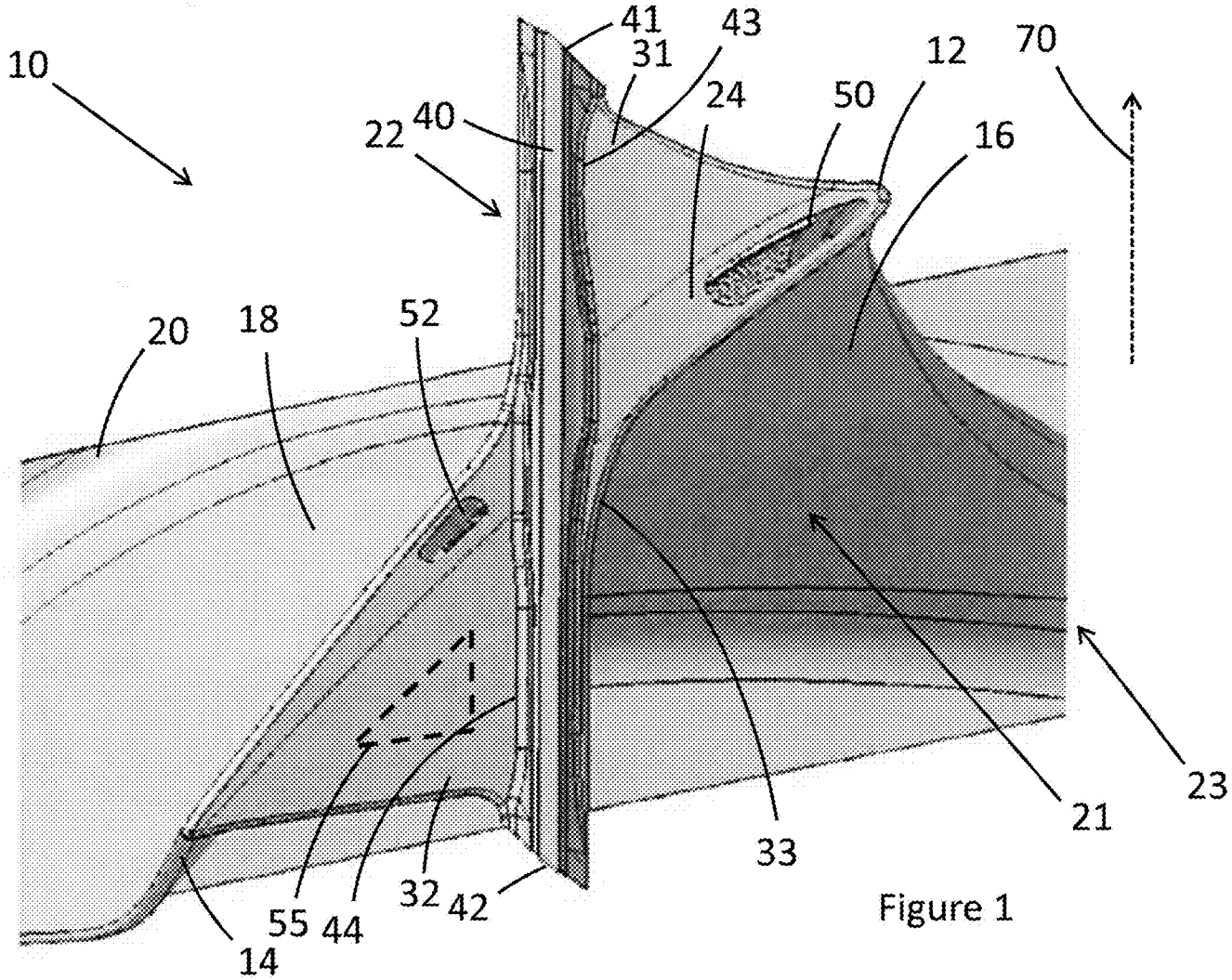
FIG. 1 shows a top view of an exemplary blade.
Figure 2:
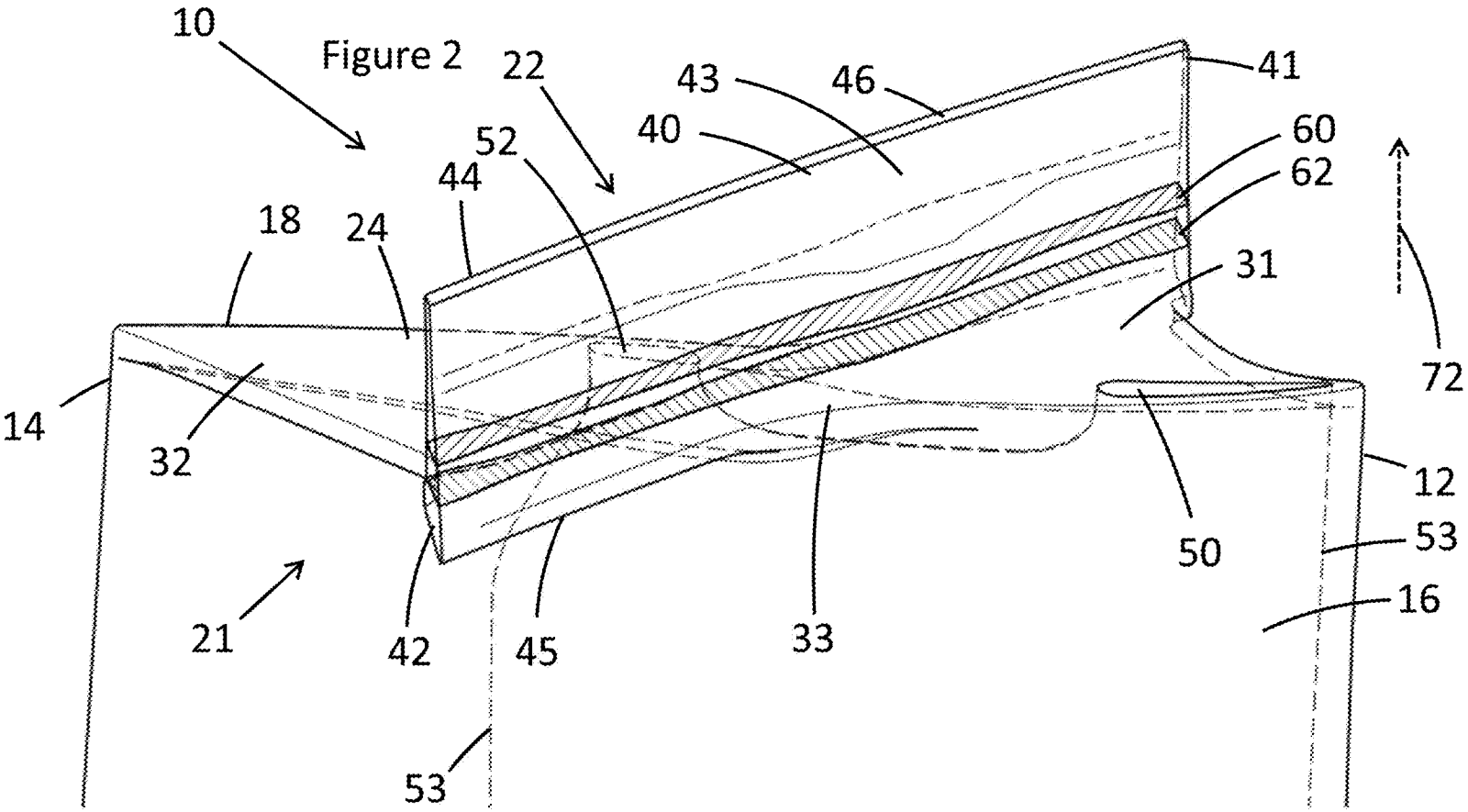
FIG. 2 shows a partially see-through perspective view of the blade of FIG. 1, including lines showing the shape of the surfaces.

FIGS. 1 and 2 show a blade 10 comprising a leading edge 12, a trailing edge 14, a pressure surface 16, a suction surface 18, a root end to be attached to a blade root 20 and a tip end 24. A tip shroud 22 is attached to the tip end 24, the tip shroud 22 comprising a platform 31, 32, 33 and a fin 40.

The fin 40 comprises a leading edge side 43 facing towards the leading edge 12 of the blade, a trailing edge side 44 facing towards the trailing edge 14 of the blade, a back end 42 and a front end 41, the leading edge side 43 and the trailing edge side 44 extending between the back end and the front end. The fin extends across the tip end 24 of the blade at an angle to the chord (the line from the leading edge to the trailing edge) of the blade 10 at the tip end 24 of the blade.

The platform comprises a first platform portion 31 and a second platform portion 32, wherein the first platform portion 31 extends from the leading edge side 43 of the fin between the front end 41 of the fin and the suction surface 18 at the tip end 24 of the blade, to the suction surface 18 at the tip end 24 of the blade between the leading edge 12 of the blade and the leading edge side 43 of the fin.

Similarly on the other side of the fin, the second platform portion 32 extends from the trailing edge side 44 of the fin between the back end 42 of the fin and the pressure surface 16 at the tip end 24 of the blade, to the pressure surface 16 at the tip end 24 of the blade between the trailing edge 14 of the blade and the trailing edge side 44 of the fin.

The tip shroud 22 is delimited by the suction surface 18 at the tip end 24 of the blade between the trailing edge 14 and the trailing edge side 44 of the tip shroud 22, and by the trailing edge side 44 of the fin between the suction surface 18 at the tip end 24 of the blade and the front end 41 of the fin.

The platform portions of the tip shroud can be thought of as extending over four separate areas delimited by the fin 40 and the tip end 24 of the blade. The first area (leading edge-suction side) contains the first platform portion 31 and the second area (trailing edge-pressure side) contains the second platform portion 32. The third area (leading edge-pressure side), extending between the pressure surface 16 of the tip end 24 of the blade and the leading edge side 43 of the fin, can optionally contain a third platform portion 33. The third platform portion 31 (see FIGS. 1 and 2) extends from the pressure surface 16 at the tip end 24 of the blade between the leading edge 12 of the blade and the leading edge side 43 of the fin, to the leading edge side 43 of the fin between the suction surface 18 at the tip end 24 of the blade and the back end 42 of the fin. In the fourth area (trailing edge-suction side), which extends from the trailing edge side 44 of the fin 40 between the back end 42 of the fin and the suction surface 18 of the tip end, to the suction surface 18 of the tip end between the trailing edge side 44 of the fin and the trailing edge 14, there is no platform.

In embodiments where the third area does not contain a third platform portion 33, the tip shroud 22 is delimited by the pressure surface 16 at the tip end 24 of the blade between the leading edge 12 and the leading edge side 43 of the fin, and by the leading edge side 43 of the fin between the pressure surface 16 at the tip end 24 of the blade and the back end 42 of the fin.

The first platform portion 31 extends over a roughly triangular area, with its first and second sides following the fin 40 and the suction surface 18 of the blade as described above. The third side extends from the front end 41 of the fin to the leading edge 12. The third side could be straight, or can have a slight concave or convex curve. The embodiment shown in the Figures has a slight concave curve, curving towards the point where the fin 40 and the tip end 24 of the blade meet. The curvature is generally gentle, with a radius of curvature greater than the length of the third side. An exception may be present on the portion of the third side closest to the fin (e.g. the 10 or 20% of the third side closest to the fin), where the curvature is considerably smaller (e.g. smaller than the width of the thinnest part of the fin). This portion of greater curvature may be necessary for manufacturing in embodiments such as those shown in the Figures, where the end of the first platform portion 31 is set back slightly from the front end 41 of the fin.

Similarly, the second platform portion 32 extends over a roughly triangular area, with its first and second sides following the fin 40 and the pressure surface 16 as described above. The third side could be straight (as in the Figures) or have a slight concave or convex curve. As with the first platform portion 31, the second platform portion 32 has a portion close to the fin 40 (e.g. the 10 or 20% of the third side closest to the fin 40), where the curvature is considerably smaller (e.g. smaller than the width of the thinnest part of the fin 40). This portion of greater curvature may be necessary for manufacturing in embodiments such as those shown in the Figures, where the end of the second platform portion 32 is set back slightly from the back end 42 of the fin 40.

In other embodiments, the curvature may also be different to that described, for example with a greater curvature.

The third platform portion 33 is preferably much smaller than the first and second platform portions 31, 32 (preferably at least three times smaller by area than the first platform, more preferably less than 20% of the area of the first platform, and most preferably less than 10% of the area of the first platform; preferably the ratios of the third platform area relative to the second platform area are similar or the same), and does not extend to the leading edge 12 or to the back end 42 of the fin. Nevertheless it may optionally extend in a similar way to the first and second platform portions, all the way from the leading edge to the back end of the fin.

The fin 40 is described briefly above and will now be discussed in more detail. The fin 40 extends beyond the tip end 24 of the blade in a direction parallel or substantially parallel to the longitudinal direction of the blade 10. The fin 40 is generally cuboidal, with the longest dimension being between the front end 41 and the back end 42, and the shortest dimension being between the leading edge side 43 and the trailing edge side 44.

The fin tip end 46 is generally substantially straight, with a slight concave curvature to mirror the curvature of the adjacent gas turbine parts when in use. The distance between the leading edge side 43 and the trailing edge side 44 at the fin tip end 46 is generally the same along the length of the fin tip end 46 from the front end 41 to the back end 42.

The distance between the leading edge side 43 and the trailing edge side 44 is constant along the fin tip end 46. The distance between the leading edge side 43 and the trailing edge side 44 is greater at the fin platform end 45 than at the fin tip end 46. The distance between the leading edge side 43 and the trailing edge side 44 at the fin platform end 45 is variable; this is discussed in more detail below.

Figure 3:
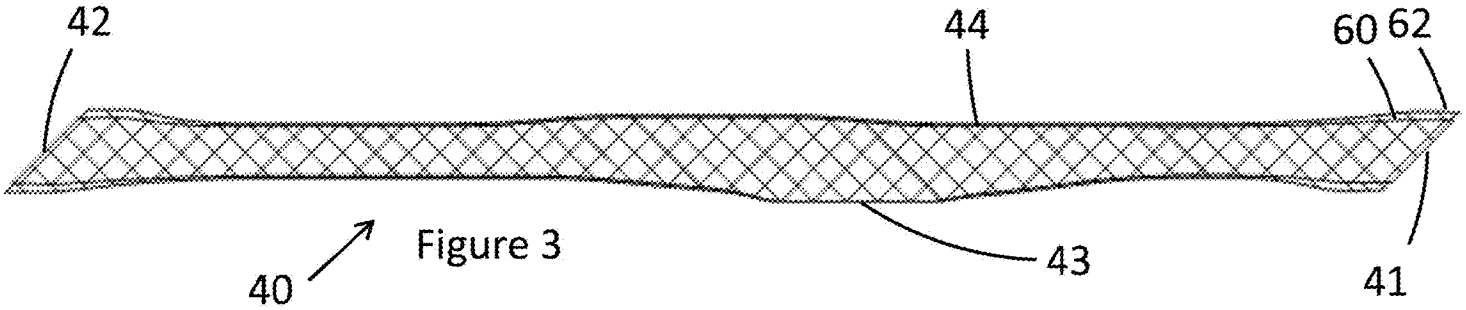
FIG. 3 shows two cross-sections 60, 62 through the fin of the blade of FIG. 2.
Figure 4:
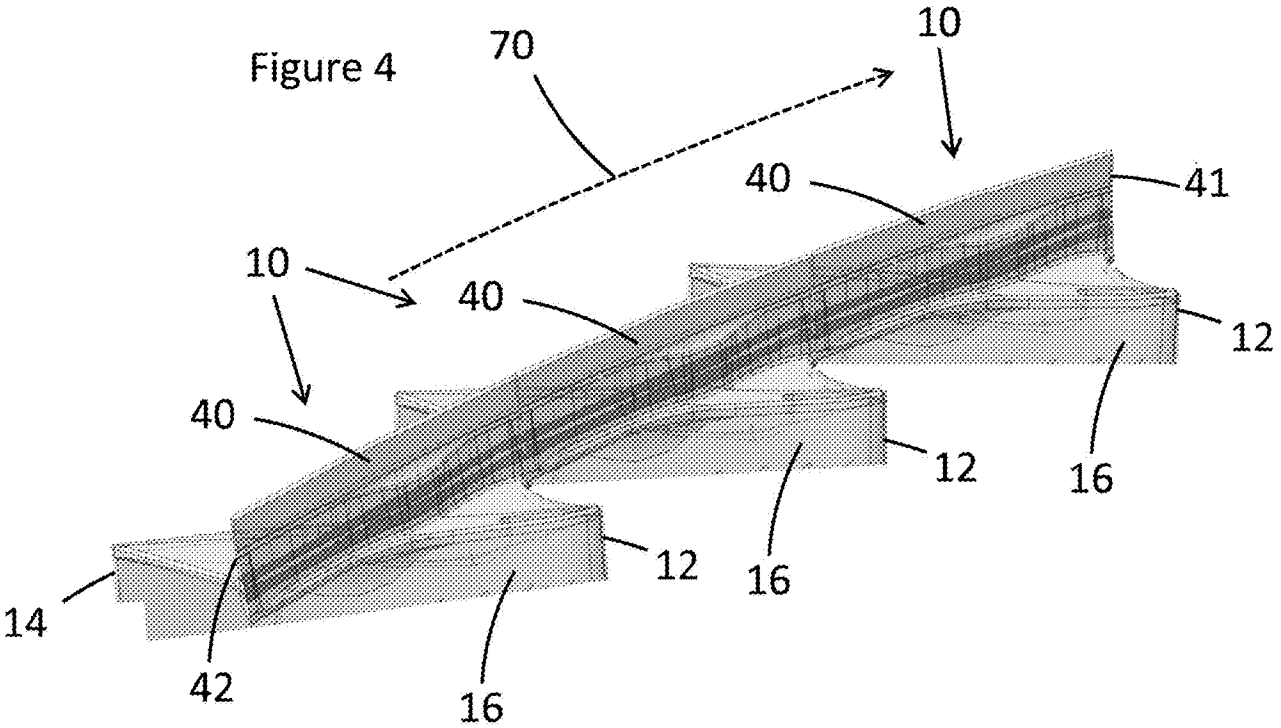
FIG. 4 shows a partially see-through perspective view of three blades according to the embodiment of FIGS. 1 to 3 adjacent to one another in a gas turbine.

The front end 41 and the back end 42 of the fin may be angled; that is, the cross-section of the fin 40 perpendicular to the longitudinal direction of the blade 10 is not a rectangle but instead a parallelogram with corner angles that do not equal 90° (as shown in FIG. 3 in particular). Similarly, the fin tip end 46 would generally also describe a parallelogram with corner angles that do not equal 90°. The faces of the front end 41 and the back end 42 of the fin should normally be parallel to one another, as they will interact with corresponding faces on adjacent blades 10 (the back end 42 of one fin interacts with the front end 41 of the fin of the adjacent blade 10), as shown in FIG. 4.

A portion of the leading edge side 43 and the trailing edge side 44 adjacent to the fin tip end 46 is preferably planar or substantially planar, as shown in the Figures. The shape of the leading edge side 43 and the trailing edge side 44 further from the fin tip end 46 transitions into a non-planar surface, with several protrusions deviating from a planar surface. That is, the shape of the leading edge side 43 and the trailing edge side 44 further from the fin tip end 46 comprise several wider portions extending from the planar surface. Firstly, the distance between the leading edge side 43 and the trailing edge side 44 increases close to the front end 41 and back end 42 of the fin. Secondly, the distance between the leading edge side 43 and the trailing edge side 44 increases close to the tip end 24 of the blade. This is closer to the front end 41 on the leading edge side 43 compared to on the trailing edge side 44, which results in an offset in the wider portion on the leading edge side 43 compared to the trailing edge side 44, and in an asymmetrical fin 40.

In FIG. 2 in particular, it can be seen that the increase in width from the fin tip end 46 to the fin platform end 45 is not necessarily smooth. In FIG. 2, the increase is smooth at the back end 42 and front end 41, but not at the portion close to the tip end 24 of the blade in the longitudinal direction of the blade, where a stepwise or substantially stepwise increase in width can be seen. Nevertheless, the increase in width would typically not be stepwise in the longitudinal direction of the fin (which is normally also the blade rotation direction), as can be seen in the Figures.

To further illustrate the variations in width and the features of the fin 40 described above, FIG. 3 shows two cross-sections 60, 62 of the fin 40 superimposed on each other for comparison. The cross-sections 60, 62 are marked on FIG. 2. The cross-section 60 is shown as lines in one direction and the cross-section 62 is shown as a lines in a second direction. This results in hatching over most of the area of the cross-sections in FIG. 3, where both sets of lines are present. The cross-section 62 is closer to the fin platform end 45, and is always wider or as wide as the cross-section 60—that is, the width of the fin 40 (from the leading edge side 43 to the trailing edge side 44) at cross-section 60 is always thinner or the same as the width of the fin 40 at cross-section 62.

Two dust holes 50, 52 are also present in the tip end 24 of the blade. The first dust hole 50 is between the leading edge 12 and the fin 40, and the second dust hole 52 is between the fin 40 and the trailing edge 14. The first dust hole 50, and the second dust hole 52 lead to a dust hole channel 53. The dust hole channel mostly extends through the blade in the longitudinal direction 72 of the blade (and/or parallel to the trailing edge 14), but near the tip end 24 of the blade the dust hole channel curves away from the trailing edge 14. The dust hole channel 53 is preferably smooth because it is loaded by the shroud overhangs and also during casting (a purpose of the dust holes can be to hold the core during casting).

The blade described above is preferably a (rotating) turbine blade for use in a gas turbine. The blade could alternatively be used in a steam turbine. FIG. 4 shows how the blades would be arranged adjacent to one another in a gas turbine. The back end 42 of the fin of one blade 10 is adjacent to the front end 41 of the fin of the adjacent blade 10. Generally, the blades are not attached to one another, but are able to move slightly relative to one another.

Preferably, the blade root 20, the main blade portion 21 and the tip shroud 22 are integrally cast as a single component, as this can provide an extremely strong component. Alternatively, some or all of the various parts may be manufactured separately and attached to the blade.

The blade shape described above is merely an example, and other blade shapes could be used. For example, the blade root 20 is optional, and may be a separate part. The specific features such as the leading edge 12, trailing edge 14 and so on may be another shape from that shown in the Figures. The blade may comprise internal cooling.

The end surface of the tip end 24 of the blade, on which the fin is mounted, may be perpendicular to the longitudinal direction 72 of the blade. Alternatively, the end surface may be slightly inclined from parallel, particularly on the portion of the tip end of the blade between the trailing edge side of the fin and the trailing edge.

The platform is described in detail in the embodiments described above, but variation in the shape and structure of the platform is possible. The first and second platform portions may extend to the front/back end of the fin, or one or more may be set back slightly from the front/back end of the fin as shown in the Figures. Similarly, the first and second platform portions may extend to the leading edge/trailing edge of the blade tip, or one or more may be set back slightly from the leading/trailing edge of the blade tip. The platform may be of a variable thickness (in the longitudinal direction of the blade). Optionally, a hole may be provided through the first and/or second platform portions, particularly through the second platform portion. The hole/s extends through the first and/or second platform portions in the longitudinal blade direction 72. Dotted line 55 in FIG. 1 shows the possible location and extent of a second platform hole, although other shapes such as circular or oval holes may also be used. Where the hole is triangular or substantially triangular in shape, or another shape with sharp corners, the corners may be rounded. Alternatively, rather than a hole at this location, this area of the platform could be thinner than the rest of the platform (for example a blind hole).

The delimitations in the tip shroud as discussed above can be thought of as being in a plane perpendicular to a longitudinal direction 72 of the blade, or in a plane containing the tip end 24 of the blade. The tip shroud can be thought of as extending out from the fin up to the delimitation point (which is only out to the edge of the fin itself for some parts of the fin).

As with the blade and the platform, various embodiments of the fin are possible besides those described above and may be combined with various different embodiments of the blade and the platform. For example, the trailing edge side and/or leading edge side may be planar. The thicker portions (where the distance from the leading edge to the trailing edge is greater) may extend part-way between the fin platform end and the fin tip end, or may extend all the way from the fin platform end to the fin tip end (up to and including the fin tip end). The distance between the trailing edge side and the leading edge side may be the same at the fin platform edge and the fin tip edge. In general, changes in width of the fin (width from the trailing edge side to the leading edge side) are gradual, but stepwise changes in width are also possible. Although the fin generally widens from the fin tip end to the fin platform end, in some embodiments there may be portions of the fin where the opposite is the case, or where the fin is wider at the fin tip end than the fin platform end.

Preferably, the fin is angled such that when in use, the longitudinal extent of the fin (from the back end to the front end) is parallel to the blade rotation direction 70. Preferably only a single fin is provided for any given blade. Preferably the back end and the front end are the same width (from the trailing edge side to the leading edge side)

An embodiment with two dust holes is described above, but one, three or more dust holes may alternatively be provided.

Preferably, the fillet radius where the fin meets the tip end of the blade is larger than the fillet radius where the platform meets the tip end of the blade.

Various modifications to the embodiments described are possible and will occur to those skilled in the art without departing from the invention which is defined by the following claims.

| Reference Signs | |
|---|---|
| 10 | blade |
| 12 | leading edge |
| 14 | trailing edge |
| 16 | pressure surface (pressure side) |
| 18 | suction surface (suction side) |
| 20 | blade root |
| 21 | main blade portion |
| 22 | tip shroud |
| 23 | root end of the blade |
| 24 | tip end of the blade |
| 31 | first platform portion |
| 32 | second platform portion |
| 33 | third platform portion |
| 40 | fin |
| 41 | front end of the fin |
| 42 | back end of the fin |
| 43 | leading edge side of the fin |
| 44 | trailing edge side of the fin |
| 45 | fin platform end |
| 46 | fin tip end |
| 50 | first dust hole |

-continued

| Reference Signs | |
|---|---|
| 52 | second dust hole |
| 53 | dust hole channel |
| 55 | second platform hole |
| 60 | fin cross-section |
| 62 | fin cross-section |
| 70 | blade rotation direction |
| 72 | longitudinal direction of the blade |

The invention claimed is:

1. A blade comprising:

a leading edge, a trailing edge, a pressure surface, a suction surface, a root end and a tip end, a tip shroud attached to the tip end, the tip shroud having a platform and a fin, wherein the fin includes:

a leading edge side facing towards the leading edge of the blade, a trailing edge side facing towards the trailing edge of the blade, a back end and a front end, the leading edge side and the trailing edge side extending between the back end and the front end, the fin extending across the tip end of the blade at an angle to the chord of the blade at the tip end of the blade, wherein the platform includes:

a first platform portion and a second platform portion, wherein the first platform portion extends from the leading edge side of the fin between the front end of the fin and the suction surface at the tip end of the blade, to the suction surface at the tip end of the blade between the leading edge of the blade and the leading edge side of the fin, wherein the second platform portion extends from the trailing edge side of the fin between the back end of the fin and the pressure surface at the tip end of the blade, to the pressure surface at the tip end of the blade between the trailing edge of the blade and the trailing edge side of the fin, wherein the tip shroud is delimited by the suction surface at the tip end of the blade between the trailing edge and the trailing edge side of the fin, and by the trailing edge side of the fin between the suction surface at the tip end of the blade and the front end of the fin, wherein the distance from the leading edge side of the fin to the trailing edge side of the fin is greater in portions near the front end of the fin, near the back end of the fin and/or near the tip end of the blade than elsewhere on the fin, and wherein the portion of the fin near the front end of the fin, where the width between the leading edge side and the trailing edge side is greater, is closer to the front end of the fin on the leading edge side of the fin than on the trailing edge side of the fin.

2. The blade of claim 1, wherein the fin comprises:

a fin platform end adjacent to the platform and a fin tip end distal from the platform and the distance from the leading edge side of the fin to the trailing edge side of the fin is greater at the fin platform end than at the fin tip end.

3. The blade of claim 1, wherein the platform comprises:

a third platform portion, and wherein the third platform portion extends from the point where the pressure surface and the leading edge side of the fin meet, wherein the third platform portion extends along the pressure surface at the tip end of the blade between the leading edge of the blade and the leading edge side of the fin, and along the leading edge side of the fin between the suction surface at the tip end of the blade and the back end of the fin.

4. The blade of claim 3, in which the area of the third platform portion is at least three times smaller than the area of the first platform portion.

5. The blade of claim 1, wherein the tip shroud is delimited by the pressure surface at the tip end of the blade between the leading edge and the leading edge side of the fin, and by the leading edge side of the fin between the pressure surface and the back end of the fin.

6. The blade of claim 1, wherein an edge of the first platform portion extends in a straight or substantially straight line from the leading edge to the front end of the fin, and/or an edge of the second platform portion extends in a straight or substantially straight line from the trailing edge to the back end of the fin.

7. The blade of claim 1, comprising:

a hole through the first and/or second platform portions.

8. The blade of claim 1, comprising:

a leading edge side dust hole in the tip end of the blade between the leading edge side of the fin and the leading edge, and a trailing edge side dust hole in the tip end of the blade between the trailing edge side of the fin and the trailing edge.

9. The blade of claim 8, wherein the trailing edge side dust hole leads to a dust hole channel that extends through the blade in a longitudinal direction of the blade, wherein the dust hole channel is further away from the trailing edge at the tip end of the blade than elsewhere in the blade.

10. The blade of claim 1, wherein a fillet radius where the fin meets the tip end of the blade is larger than a fillet radius where the platform meets the tip end of the blade.

11. A gas turbine comprising:

the blade according to claim 1.

12. A method of manufacture of a blade according to claim 1, the method comprising:

forming the blade by casting.

13. A blade comprising:

a leading edge, a trailing edge, a pressure surface, a suction surface, a root end and a tip end, a tip shroud attached to the tip end, the tip shroud having a platform and a fin, wherein the fin includes:

a leading edge side facing towards the leading edge of the blade, a trailing edge side facing towards the trailing edge of the blade, a back end and a front end, the leading edge side and the trailing edge side extending between the back end and the front end, the fin extending across the tip end of the blade at an angle to the chord of the blade at the tip end of the blade, wherein the platform includes:

a first platform portion and a second platform portion, wherein the first platform portion extends from the leading edge side of the fin between the front end of the fin and the suction surface at the tip end of the blade, to the suction surface at the tip end of the blade between the leading edge of the blade and the leading edge side of the fin, wherein the second platform portion extends from the trailing edge side of the fin between the back end of the fin and the pressure surface at the tip end of the blade, to the pressure surface at the tip end of the blade between the trailing edge of the blade and the trailing edge side of the fin, wherein the tip shroud is delimited by the suction surface at the tip end of the blade between the trailing edge and the trailing edge side of the fin, and by the trailing edge side of the fin between the suction surface at the tip end of the blade and the front end of the fin, and wherein the platform comprises:

a third platform portion, and wherein the third platform portion extends from the point where the pressure surface and the leading edge side of the fin meet, wherein the third platform portion extends along the pressure surface at the tip end of the blade between the leading edge of the blade and the leading edge side of the fin, and along the leading edge side of the fin between the suction surface at the tip end of the blade and the back end of the fin.

14. The blade of claim 13, comprising:

a leading edge side dust hole in the tip end of the blade between the leading edge side of the fin and the leading edge, and a trailing edge side dust hole in the tip end of the blade between the trailing edge side of the fin and the trailing edge.

15. The blade of claim 14, wherein the trailing edge side dust hole leads to a dust hole channel that extends through the blade in a longitudinal direction of the blade, wherein the dust hole channel is further away from the trailing edge at the tip end of the blade than elsewhere in the blade.

16. A gas turbine comprising:

the blade according to claim 13.

17. A blade comprising:

a leading edge, a trailing edge, a pressure surface, a suction surface, a root end and a tip end, a tip shroud attached to the tip end, the tip shroud having a platform and a fin, wherein the fin includes:

a leading edge side facing towards the leading edge of the blade, a trailing edge side facing towards the trailing edge of the blade, a back end and a front end, the leading edge side and the trailing edge side extending between the back end and the front end, the fin extending across the tip end of the blade at an angle to the chord of the blade at the tip end of the blade, wherein the platform includes:

a first platform portion and a second platform portion, wherein the first platform portion extends from the leading edge side of the fin between the front end of the fin and the suction surface at the tip end of the blade, to the suction surface at the tip end of the blade between the leading edge of the blade and the leading edge side of the fin, wherein the second platform portion extends from the trailing edge side of the fin between the back end of the fin and the pressure surface at the tip end of the blade, to the pressure surface at the tip end of the blade between the trailing edge of the blade and the trailing edge side of the fin, and wherein the tip shroud is delimited by the suction surface at the tip end of the blade between the trailing edge and the trailing edge side of the fin, and by the trailing edge side of the fin between the suction surface at the tip end of the blade and the front end of the fin, and wherein a fillet radius where the fin meets the tip end of the blade is larger than a fillet radius where the platform meets the tip end of the blade.

18. The blade of claim 17, comprising:

a leading edge side dust hole in the tip end of the blade between the leading edge side of the fin and the leading edge, and/or a trailing edge side dust hole in the tip end of the blade between the trailing edge side of the fin and the trailing edge.

19. The blade of claim 18, wherein the trailing edge side dust hole leads to a dust hole channel that extends through the blade in a longitudinal direction of the blade, wherein the dust hole channel is further away from the trailing edge at the tip end of the blade than elsewhere in the blade.

20. A gas turbine comprising:

the blade according to claim 17.

* * * * *